US008525739B2

(12) United States Patent
Lee et al.

(10) Patent No.: US 8,525,739 B2
(45) Date of Patent: Sep. 3, 2013

(54) ANTENNA DEVICE AND PORTABLE TERMINAL HAVING THE SAME

(75) Inventors: Jaegon Lee, Seoul (KR); Ansun Hyun, Seoul (KR); Euntaek Jeoung, Gyeonggi-Do (KR); Yochuol Ho, Gyeonggi-Do (KR); Viktor Kalinichev, Moscow (RU)

(73) Assignee: LG Electronics Inc., Seoul (KR)

( * ) Notice: Subject to any disclaimer, the term of this patent is extended or adjusted under 35 U.S.C. 154(b) by 366 days.

(21) Appl. No.: 12/908,790

(22) Filed: Oct. 20, 2010

(65) Prior Publication Data

US 2011/0128192 A1 Jun. 2, 2011

(30) Foreign Application Priority Data

Dec. 2, 2009 (KR) ..... 10-2009-0118688

(51) Int. Cl.
*H01Q 1/24* (2006.01)

(52) U.S. Cl.
USPC ..... 343/702; 343/700 MS

(58) Field of Classification Search
USPC ..... 343/700 MS, 702, 909
See application file for complete search history.

(56) References Cited

U.S. PATENT DOCUMENTS

| | | | | |
|---|---|---|---|---|
| 6,262,495 | B1 * | 7/2001 | Yablonovitch et al. | 307/101 |
| 6,433,756 | B1 * | 8/2002 | Sievenpiper et al. | 343/909 |
| 6,906,674 | B2 * | 6/2005 | McKinzie et al. | 343/767 |
| 8,188,928 | B2 * | 5/2012 | Lin et al. | 343/700 MS |
| 2003/0201938 | A1 | 10/2003 | Dening et al. | |
| 2008/0129511 | A1 | 6/2008 | Yuen et al. | |

FOREIGN PATENT DOCUMENTS

| | | |
|---|---|---|
| WO | WO 02/41447 A1 | 5/2002 |

* cited by examiner

*Primary Examiner* — Hoanganh Le
(74) *Attorney, Agent, or Firm* — Birch, Stewart, Kolasch & Birch, LLP

(57) ABSTRACT

Disclosed are an antenna device and a portable terminal having the same. The portable terminal includes a terminal body, a radiator including a conductive material, and configured in a preset pattern to transmit or receive wireless signals, a circuit board mounted to the terminal body, and configured to process the wireless signal by being electrically connected to the radiator, and an artificial magnetic conductor module disposed near the radiator, and configured to reflect the wireless signal.

15 Claims, 12 Drawing Sheets

ANTENNA DEVICE AND PORTABLE TERMINAL HAVING THE SAME

CROSS-REFERENCE TO A RELATED APPLICATION

Pursuant to 35 U.S.C. §119(a), this application claims the benefit of earlier filing date and right of priority to Korean Application No. 10-2009-0118688, filed on Dec. 2, 2009, the contents of which is incorporated by reference herein in its entirety.

BACKGROUND OF THE INVENTION

1. Field of the Invention

The present invention relates to a portable terminal, and particularly, to a portable terminal having an antenna device for transmitting and receiving wireless signals.

2. Background of the Invention

In general, a terminal may be classified into a mobile (portable) terminal and a stationary terminal according to a moveable state. The mobile terminal may be also classified into a handheld terminal and a vehicle mount terminal according to a user's carriage method.

As functions of the terminal become more diversified, the terminal can support more complicated functions such as capturing images or video, reproducing music or video files, playing games, receiving broadcast signals, and the like. By comprehensively and collectively implementing such functions, the mobile terminal may be embodied in the form of a multimedia player or device.

Various attempts have been made to implement complicated functions in such a multimedia device by means of hardware or software. For instance, a User Interface (UI) environment is provided in a portable terminal to enable a user to easily and conveniently search for or select a desired function among available functions.

As the portable terminal is regarded as personal belongings to express a user's personality, various designs are required.

The various designs include structural changes and improvements to enhance the user's convenience. For the structural changes and improvements, an antenna device may be researched.

SUMMARY OF THE INVENTION

Therefore, an object of the present invention is to provide a portable terminal having an antenna device of a more enhanced function.

Another object of the present invention is to provide a portable terminal having a slimmer configuration, and an antenna device.

To achieve these and other advantages and in accordance with the purpose of the present invention, as embodied and broadly described herein, there is provided a portable terminal, comprising: a terminal body; a radiator formed of a conductive material and configured in a preset pattern so as to transmit or receive wireless signals; a circuit board mounted to the body, and configured to process the wireless signal by being electrically connected to the radiator; and an artificial magnetic conductor module disposed near the radiator, and configured to reflect the wireless signal, wherein the artificial magnetic conductor module comprises a conductive ground layer, a first conductive layer electrically connected to the conductive ground layer, and having a plurality of first conductors arranged at positions spacing from the conductive ground layer, and a second conductive layer formed to cover the first conductive layer and having second conductors arranged in parallel to the first conductors.

According to one embodiment of the present invention, slits may be formed between the first conductors adjacent to each other, and the second conductors may be arranged to cover the slits. The second conductors may be arranged at the same interval as the first conductors.

According to another embodiment of the present invention, each of the first and second conductors may be provided with a length and a width, and may be arranged so as to be long in a length direction and so as to be consecutive in a width direction. Each of the first and second conductive layers may be arranged such that the first and second conductors are disposed on one line in one direction. The radiator may be formed so as to be parallel to the second conductor at a position adjacent to the second conductor. A spacing distance between the first conductive layer and the second conductive layer may be shorter than a spacing distance between the conductive ground layer and the first conductive layer.

According to another embodiment of the present invention, the artificial magnetic conductor module may further comprise a first dielectric substance filled between the conductive ground layer and the first conductive layer; and a second dielectric substance filled between the first conductive layer and the second conductive layer. The first dielectric substance may be provided with an upper surface, a lower surface, and side surfaces. The first conductors may be formed on the upper surface of the first dielectric substance, and the conductive ground layer may be formed on the lower surface of the first dielectric substance. On the side surfaces of the first dielectric substance, may be formed a connection path for electrically connecting the first conductors arranged at an edge of the first dielectric substance to the conductive ground layer.

According to another embodiment of the present invention, the portable terminal may comprise a supporting member. One surface of the supporting member may be arranged at the second conductive layer, and another surface of the supporting member may be provided with the radiator. The supporting member may be implemented as a thin film formed of a non-conductive material. The supporting member or the radiator may be configured to cover one or more parts of each of the second conductors.

According to another embodiment of the present invention, at least one of a display for displaying visual information and a user input unit for inputting a control command may be disposed on one surface of the body. The artificial magnetic conductor module may be disposed near the display or the user input unit, and the radiator may be disposed near another surface of the body.

According to another embodiment of the present invention, the artificial magnetic conductor module may be mounted to the circuit board, and each of the conductive ground layer and the radiator may be electrically connected to the circuit board. Via holes through which the conductive ground layer and a ground layer of the circuit board are electrically connected to each other may be formed at the circuit board.

To achieve these and other advantages and in accordance with the purpose of the present invention, as embodied and broadly described herein, there is also provided an antenna device for a portable terminal, the antenna device comprising: a radiator formed in a preset pattern so as to transmit or receive wireless signals; and an artificial magnetic conductor module disposed near the radiator, and configured to reflect the wireless signal, wherein the artificial magnetic conductor module comprises a conductive ground layer, a first conductive layer conductors electrically connected to the conductive ground layer, and having a plurality of first conductors arranged at positions spacing from the conductive ground layer, and a second conductive layer formed to cover the first conductive layer and having second conductors arranged in parallel to the first conductors.

To achieve these and other advantages and in accordance with the purpose of the present invention, as embodied and broadly described herein, there is provided a portable terminal including a terminal body, a radiator including a conductive material, and configured in a preset pattern to transmit or receive wireless signals, a circuit board mounted to the terminal body, and configured to process the wireless signal by being electrically connected to the radiator, and an artificial magnetic conductor module disposed near the radiator, and configured to reflect the wireless signal.

To achieve these and other advantages and in accordance with the purpose of the present invention, as embodied and broadly described herein, there is also provided an antenna device for a portable terminal, the antenna device including a radiator formed in including a preset pattern, so as and configured to transmit or receive wireless signals; and an artificial magnetic conductor module disposed near the radiator, and configured to reflect the wireless signal.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
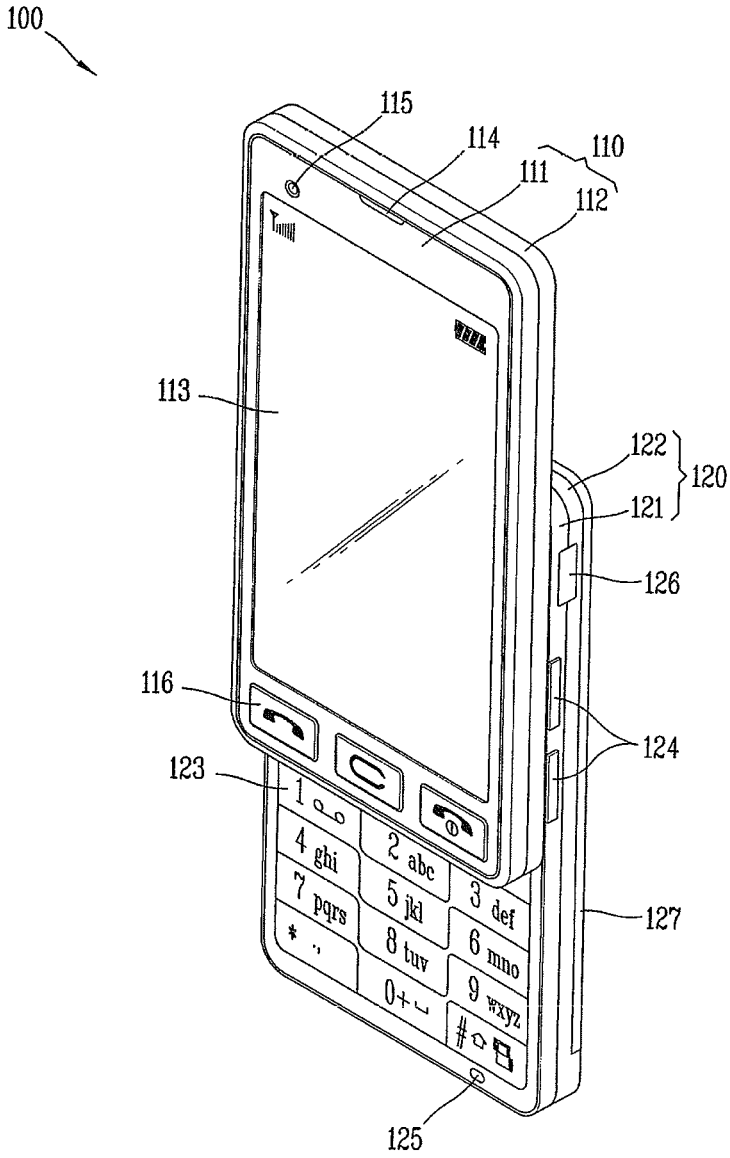
FIG. 1 is a perspective view of a portable terminal according to one embodiment of the present invention.

Description will now be given in detail of the present invention, with reference to the accompanying drawings.

For the sake of brief description with reference to the drawings, the same or equivalent components will be provided with the same reference numbers, and description thereof will not be repeated.

Hereinafter, a portable terminal according to the present invention will be explained in more detail.

The same reference numerals will be given to the same components as those of the aforementioned embodiment, and their explanations will be omitted. The singular expression of the present invention may include a plural concept unless distinctively differently defined.

The portable terminal according to the present invention may include a portable phone, a smart phone, a laptop computer, a digital broadcasting terminal, Personal Digital Assistants (PDA), Portable Multimedia Player (PMP), a navigation system, etc.

FIG. 1 is a perspective view of a portable terminal according to one embodiment of the present invention.

A body of the portable terminal 100 of the present invention comprises a first body 110, and a second body 120 coupled to the first body 110 by being slid along at least one direction. The present invention may not be limited to the slide type portable terminal, but may be applied to various types such as a bar type, a folder type, a swing type, and a swivel type.

A state that the first body 110 completely overlaps the second body 120 may be referred to as a 'closed configuration', whereas a state that one or more parts of the second body 120 are exposed by the first body 110 may be referred to as an 'open configuration'.

Under the closed configuration, the portable terminal is operated in a standby mode. However, the standby mode may be released by a user's manipulation. On the contrary, under the opened configuration, the portable terminal is operated in a call mode, etc. The call mode may be converted into the standby mode by a user's manipulation or after time lapses.

A case forming the appearance of the first body 110 (casing, housing cover, etc.) is formed by a front case 111 and a rear case 112. Each kind of electronic components are mounted in a space formed by the front case 111 and the rear case 112. If desired, one or more intermediate cases may be provided between the front case 111 and the rear case 112. The front and rear cases are usually formed by injection-molding resin material, or formed using metallic material such as stainless steel (STS) and titanium (Ti).

On the front case 111 of the first body 110, may be disposed a display unit 113, an audio output unit 114, a first image input unit 115 or a first manipulation unit 116.

The display unit 113 may be implemented as a Liquid Crystal Display (LCD) module or an Organic Light Emitting Diodes (OLED) module, a Transparent OLED (TOLED) module, and so on.

The display unit 113 may also be configured to further include a touch pad for allowing information to be input by a user's touch. And, the display unit 113 may be configured to generate various tactile effects when being touched by a user. This may be implemented by a haptic module interworking with the display unit 113. A representative tactile effect generated by the haptic module includes vibration. The haptic module may be variously arranged according to configuration aspects of not only the display unit 113, but also the portable terminal.

The audio output unit 114 may be implemented as a speaker or a receiver.

The first image input unit 115 may be implemented as a camera module configured to capture a user's still images or moving images.

The first manipulation unit 116 is configured to receive commands to control the operation of the portable terminal according to the present invention. The first manipulation unit 116 may be implemented as a touch screen together with the display unit 113.

Like the first body 110, a case of the second body 120 may be formed by a front case 121 and a rear case 122.

A second manipulation unit 123 may be disposed on a front surface of the front case 121 of the second body 120.

A third manipulation unit 124, a first audio input unit 125, and an interface 126 may be disposed on at least one of the front case 121 and the rear case 122.

The first to third manipulation units 116, 123 and 124 may be referred to as a manipulation unit, and may include any type of ones that can be manipulated in a user's tactile manner.

The manipulation unit may be implemented as dome switches or a touch pad for receiving commands or information by a user's push or touch operation, or may be implemented as a jog wheel or a joystick.

In the aspect of functions, the first manipulation unit 116 may be used to input commands such as START, END, and SCROLL, and the second manipulation unit 123 may serve numbers, characters, symbols, etc. And, the third manipulation unit 124 may serve as hot keys for performing specific functions such as activation of the first image input unit 115.

The first audio input unit 125 may be implemented as a microphone so as to receive a user's voice or other sounds.

The interface 126 may serve as a passage through which the portable terminal of the present invention exchanges data with an external device. For instance, the interface 126 may be implemented as at least one of a wired/wireless connection port for connecting an earphone to the portable terminal, a short-range communications port (e.g., an Infrared Data Association (IrDA) port, a Bluetooth port, a wireless LAN port, etc.), power supply ports for providing power to the portable terminal, or the like.

The interface 126 may be configured using a card socket (e.g., for coupling to a memory card, a subscriber identity module (SIM) card, a user identity module (UIM) card, etc.).

Figure 2:
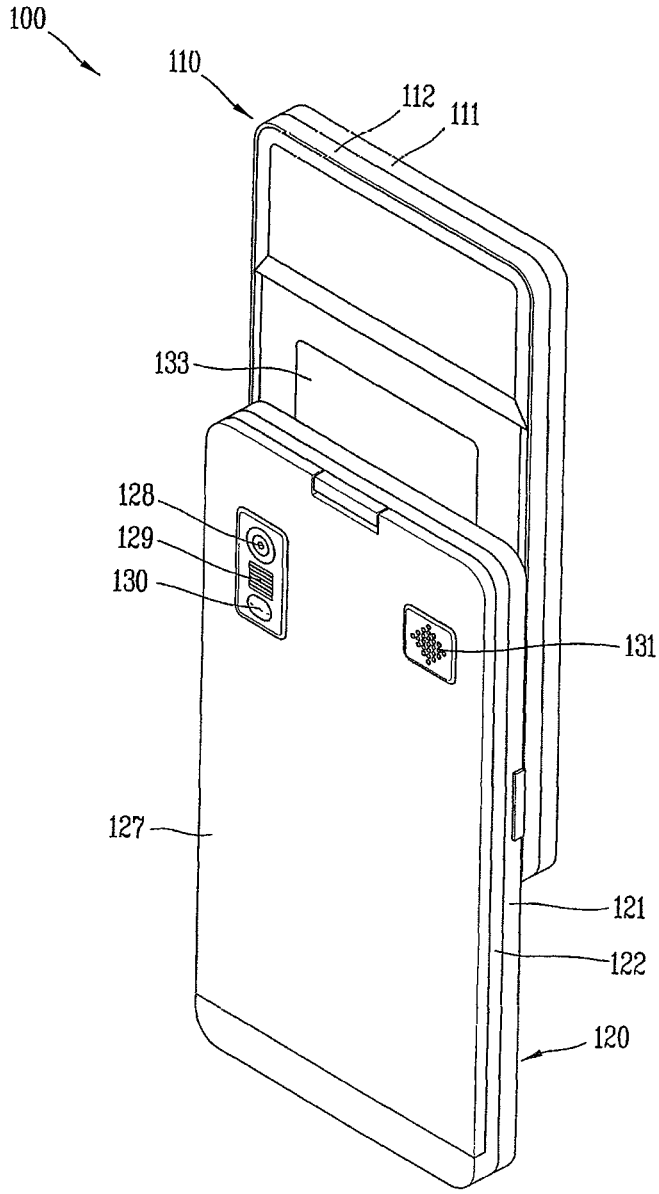
FIG. 2 is a rear perspective view of the portable terminal of FIG. 1.

FIG. 2 is a perspective view of a rear surface of the portable terminal of FIG. 1.

Referring to FIG. 2, a second image input unit 128 may be additionally mounted to a rear surface of the rear case 122. The second image input unit 128 faces a direction which is opposite to a direction faced by the first image input unit 115 (refer to FIG. 1), and may have pixels different from those of the first image input unit 115.

For example, the first image input unit 115 may operate with relatively lower pixels (lower resolution). Thus, the first image input unit 115 may be useful when a user can capture his face and send it to a calling party in a video call mode or the like. On the other hand, the second image input unit 128 may operate with a relatively higher pixels (higher resolution) such that it can be useful for a user to obtain higher quality pictures for later use.

A flash 129 and a mirror 130 may be additionally disposed adjacently to the second image input unit 128. When capturing an object by using the second image input unit 128, the flash 129 provides light to the object. The mirror 130 can cooperate with the second image unit 128 to allow a user to photograph himself or herself in a self-portrait mode.

It was explained that the second image input unit 128 is disposed at the second body 120. However, the position of the second image input unit 128 is not limited to the second body 120. For instance, at least one of the components 128 to 131 originally disposed at the rear case 122 may be mounted to the rear case 112 of the first body 110. In this case, the components disposed at the rear case 112 may be protected by the second body 120 in the closed configuration. Furthermore, even if the second image input unit 128 is not additionally provided, the first image input unit 115 configured to be rotatable may capture an image even in a capturing direction by the second image input unit 128.

A second audio output unit 131 may be additionally disposed at the rear case 122.

The second audio output unit 131 may implement a stereo function together with the first audio output unit 114 (refer to FIG. 1), and may be used for calling in a speaker phone mode.

An antenna for calling, Bluetooth communication or GPS communication, etc. may be provided at the terminal body. A broadcast signal receiving antenna 132 as well as the antenna may be disposed at the rear case 112. The broadcast signal receiving antenna 132 may be configured to retract into the first body 110.

One portion of a slide module 133 that slidably couples the first body 110 and the second body 120 to each other is disposed at the rear case 112 of the first body 110. Another portion of the slide module 133 is disposed at the front case 121 of the second body 120, thereby not being exposed out.

A power supply unit 127 for supplying power to the portable terminal is mounted at the rear case 122. The power supply unit 127 may be a rechargeable battery, for example, to be detachably mounted to the rear case 122 for charging.

Figure 3:
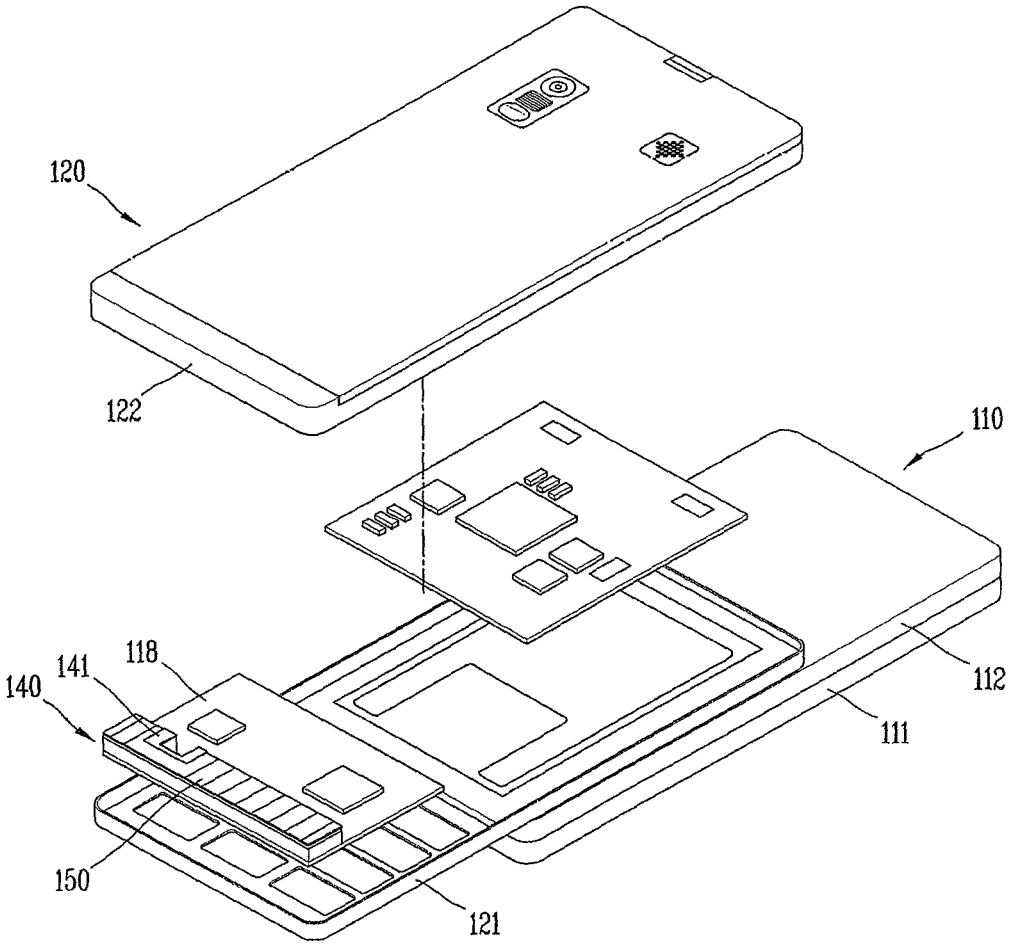
FIG. 3 is a disassembled perspective view of a second body of the portable terminal of FIG. 2.
Figure 4:
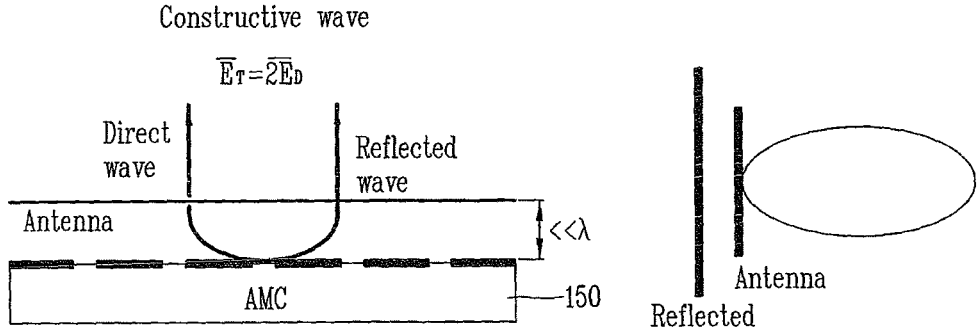
FIG. 4 is a conceptual view showing radiation of electromagnetic waves by an antenna device of FIG. 3.

FIG. 3 is a disassembled perspective view of the second body 120 of the portable terminal of FIG. 2, and FIG. 4 is a conceptual view showing radiation of electromagnetic waves by an antenna device 140 of FIG. 3.

Referring to FIGS. 3 and 4, a circuit board 118 is arranged so as to be adjacent to one end of the second body 120. For instance, the circuit board 118 is mounted to the front case 121 or the rear case 122 of the second body 120. The circuit board 118 is arranged so as to be covered by an inner surface of the rear case 122.

The circuit board 118 is arranged on a rear surface of the second manipulation unit 123 (refer to FIG. 1) adjacent to one end of the second body 120, and switches configured to receive control commands by the second manipulation unit 123 may be mounted to one surface of the circuit board 118.

The circuit board 118 may be implemented as one example of the controller 180 (refer to FIG. 11) for controlling the portable terminal so as to operate each function. The circuit board 118 is configured to process a signal corresponding to a wireless electromagnetic wave transmitted or received by the antenna device 140.

The antenna device 140 is mounted on another surface of the circuit board 118 in the present invention. However, the present invention is not limited to this. For instance, the antenna device 140 may be mounted on the rear case 122 of the second body 120, or on the front case 111 and the rear case 112 of the first body 110.

The antenna device 140 includes a radiator 141 implemented as a conductive material forms a preset pattern so as to transmit and receive wireless signals. The radiator 141 is electrically connected to the circuit board 118 so as to process wireless signals.

The radiator 141 is formed so as to transmit and receive a wireless electromagnetic wave of a specific frequency bandwidth. The frequency bandwidth may correspond to a Global Positioning System (GPS), Bluetooth), MediaFLO (Media Forward Link Only), a wireless communications system, etc.

An artificial magnetic conductor (AMC) module 150 configured to reflect wireless signals is arranged so as to be adjacent to the radiator 141. The AMC module 150 is mounted on the circuit board 118, and the radiator 141 is mounted on the AMC module 150. More concretely, the radiator 141 is arranged so as to be adjacent to an inner surface of the rear case 122.

Referring to FIG. 4, a radiated state of electromagnetic waves implemented by the AMC module 150 is different from that when the AMC module 150 is not implemented.

Electromagnetic waves are radiated to one direction due to reflection by the AMC module 150, and the sum of direct electromagnetic waves (ED) and reflected electromagnetic waves (ER=ED) reflected from the AMC module 150 is entire electromagnetic waves (ET) radiated to one direction. The reason is because a zero phase difference is generated when electromagnetic waves are reflected from the AMC module 150, and thereby an image current is generated in the same direction.

Referring to FIG. 3 again, the AMC module 150 reflects electromagnetic waves toward the front case 122 among electromagnetic waves radiated from the radiator 141, toward the rear case 122. Generally, during wireless communications, one surface of the front case 122 is toward a user's head, and electromagnetic waves toward the front case 122 are absorbed into a human's body. However, as the AMC module 150 is configured to reflect electromagnetic waves, a specific absorption rate (SAR) of electromagnetic waves in a human's body may be decreased, and radiating efficiency may be enhanced.

The rear case 121 may be formed of a metallic material. Since the AMC module 150 is configured to reflect electromagnetic waves, an antenna performance is not degraded even if the rear case 121 is formed of a metallic material.

Figure 5:
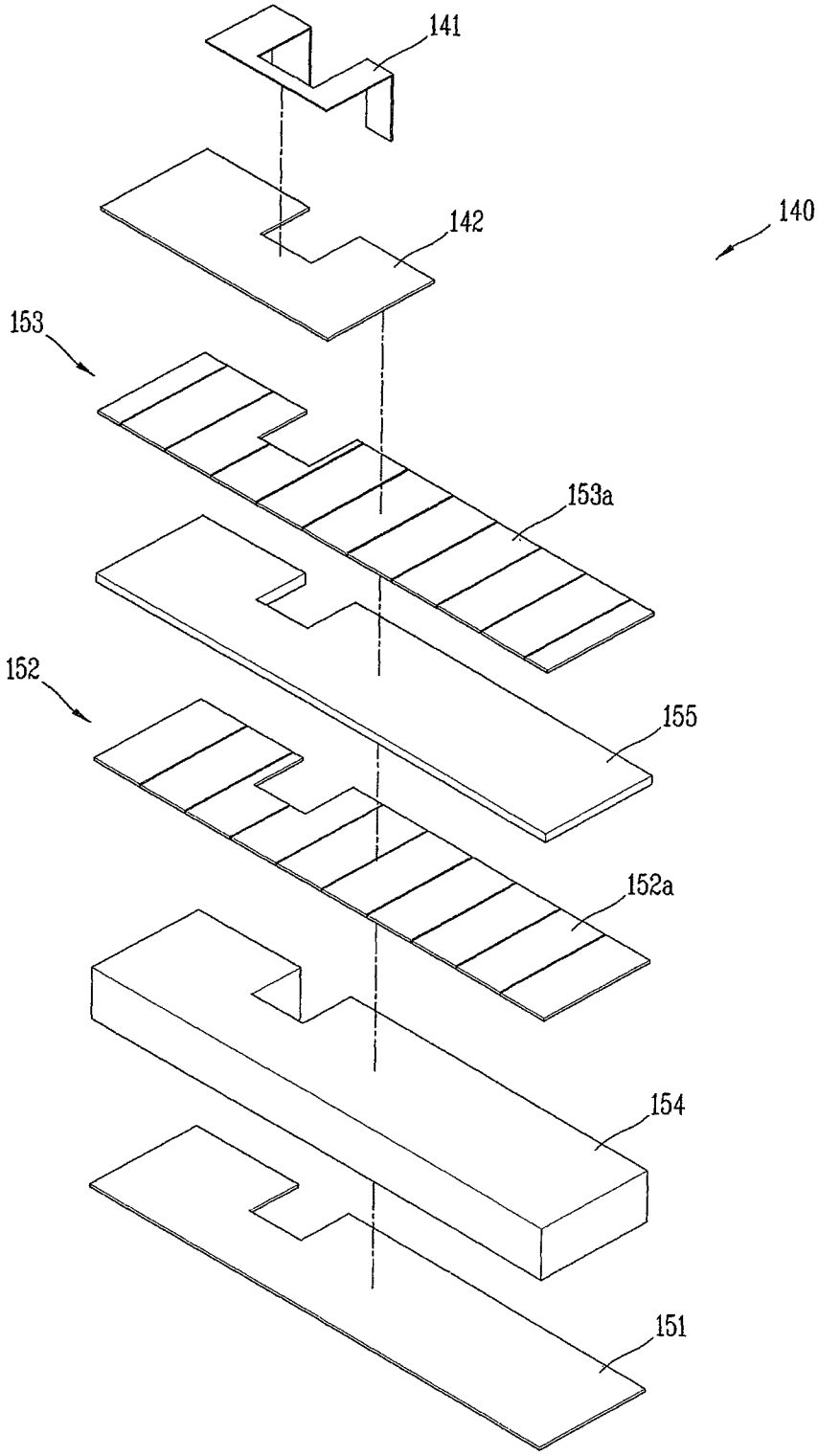
FIG. 5 is a disassembled perspective view of the antenna device of FIG. 3.
Figure 6A:
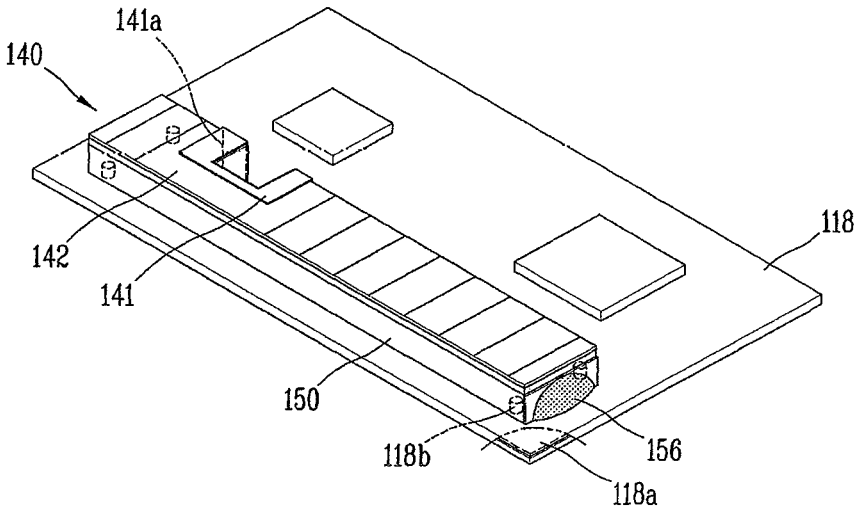
FIG. 6A is an enlarged view of a circuit board and the antenna device of FIG. 3.
Figure 6B:
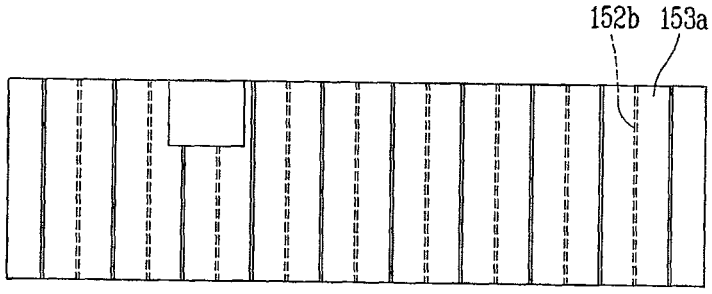
FIG. 6B is a planar view of an artificial magnetic conductor module of FIG. 5.

Hereinafter, a detailed structure of the antenna device 140 will be explained with reference to FIGS. 5 to 7. FIG. 5 is a disassembled perspective view of the antenna device of FIG. 3, FIG. 6A is an enlarged view of the circuit board 118 and the antenna device 140 of FIG. 3, FIG. 6B is a planar view of the artificial magnetic conductor (AMC) module 150 of FIG. 5, and FIG. 7 is a conceptual view showing a principle that the AMC module 150 of FIG. 3 is formed of an artificial magnetic conductor.

Figure 7:
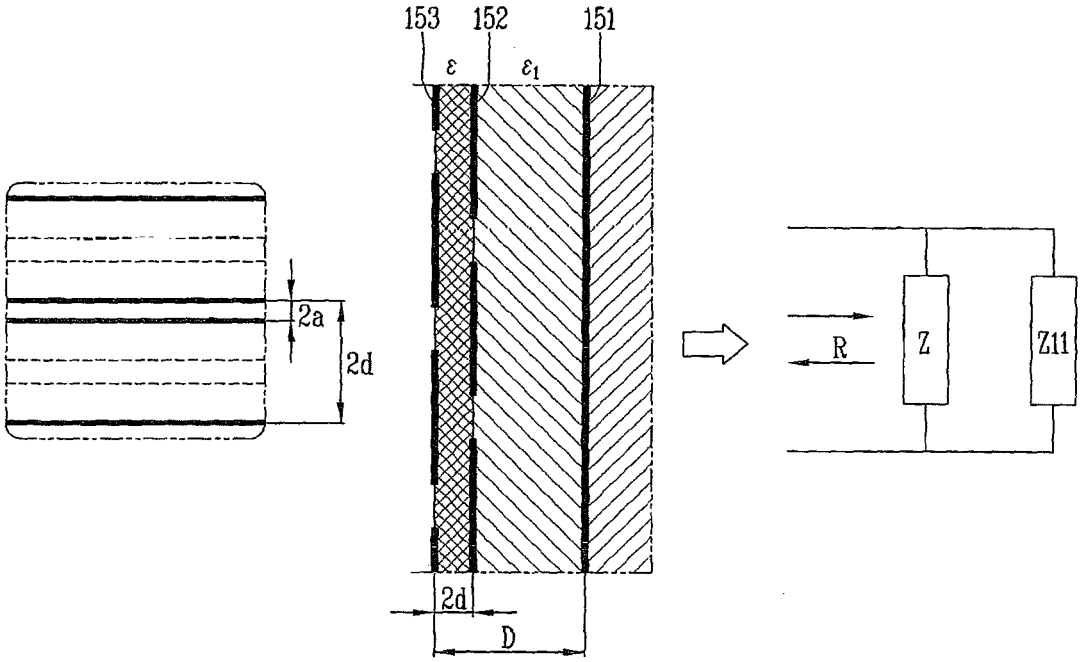
FIG. 7 is a conceptual view showing a principle that the artificial magnetic conductor module of FIG. 3 is formed of an artificial magnetic conductor.

Referring to FIGS. 5 to 7, the AMC module 150 includes a conductive ground layer 151, and first and second conductive layers 152 and 153.

The conductive ground layer 151 may be formed of a metallic material, and serve as a ground of an electric circuit formed by the AMC module 150.

The first conductive layer 152 is electrically connected to the conductive ground layer 151, and has a plurality of first conductors 152*a* arranged at positions spacing from the conductive ground layer 151.

The second conductive layer 153 is formed to cover the first conductive layer 152 at positions spacing from the first conductive layer 152. The second conductive layer 153 has a plurality of second conductors 153*a* arranged in parallel to the first conductors 152*a*.

Each of the first and second conductors 152*a* and 153*a* is provided with a length and a width, and is arranged so as to be long in a length direction and so as to be consecutive in a width direction. More concretely, the first and second conductors 152*a* and 153*a* are arranged on one line in one direction. This arrangement allows simple fabrication processes, and a low defective ratio at the time of the fabrications.

Referring to FIG. 5, the AMC module 150 includes first and second dielectric substances 154 and 155.

The first dielectric substance 154 is filled between the conductive ground layer 151 and the first conductive layer 152, and the second dielectric substance 155 is filled between the first conductive layer 152 and the second conductive layer 153. That is, the AMC module 150 has a structure that the conductive ground layer 151, the first dielectric substance 154, the first conductive layer 152, the second dielectric substance 155, and the second conductive layer 153 are sequentially laminated on each other.

Referring to FIGS. 6A and 6B, the second conductors 153*a* are arranged to cover a gap between the first conductors 152*a* adjacent to each other. That is, the first and second conductive layers 152 and 153 are implemented so that centers of arrangement pitches of the first and second conductors 152*a* and 153*a* can not be on the same line.

The second conductors 153*a* may be arranged at the same interval as the first conductors 152*a*. A slit 152*b* is formed between the first conductors 152*a* of the first conductive layer 152, and the slit 152*b* is positioned at each center of the second conductors 153*a*.

FIG. 7 is a conceptual view showing a principle that the AMC module 150 of FIG. 5 is formed of an artificial magnetic conductor.

Referring to the illustrated parameters, an impedance (Z) between the first and second conductive layers 152 and 153 may be expressed as the following formula. Here, the '1/λ' indicates a frequency, and the '∈' indicates a dielectric constant.

$$Z = \frac{-jd\lambda}{\pi\varepsilon(b-2a)b}$$

An impedance (Z11) between the first conductive layer 152 and the conductive ground layer 151 may be expressed as the following formula.

$$Z_{11}=jkD$$

$$k\sqrt{\in_1}D<<1$$

An entire impedance (Z22) may be expressed as the following formula.

$$Z_{22} = \frac{Z_{11}Z}{Z_{11}+Z}$$

Accordingly, the entire impedance (Z22) has a limitless value in a condition that 'Z+Z11=0'.

Referring to FIGS. 5 and 6, the radiator 141 is formed in parallel to the second conductors 153*a* at a position adjacent to the second conductors 153*a*. More concretely, the radiator 141 is formed at a supporting member 142.

One surface of the supporting member 142 is arranged so as to cover the second conductive layer 153, and another surface of the supporting member 142 is provided with the radiator 141. The radiator 141 is implemented as a thin film formed of copper and silver, and is patterned on a surface of the supporting member 142. The supporting member 142 may be implemented as a thin film formed of a non-conductive material such as synthetic resin.

A spacing distance between the first conductive layer 152 and the second conductive layer 153 may be shorter than a spacing distance between the conductive ground layer 151 and the first conductive layer 152. That is, the first dielectric substance 154 is formed to have a thickness thicker than that of the second dielectric substance 155.

Referring to parameters of FIG. 7, a frequency may be expressed as follows. Here, the 'C' indicates a capacitance of the antenna device.

$$freq_{HIS} = \frac{c}{\pi\sqrt{2}\sqrt{\frac{\varepsilon Db(b-2a)}{d}}}$$

If the spacing distance between the conductive ground layer 151 and the first conductive layer 152 is longer than the spacing distance between the first conductive layer 152 and the second conductive layer 153, a frequency transmitted or received by the radiator 141 may be included in a frequency band used in the portable terminal. More concretely, the frequency may be included in a frequency band of Wideband Code Division Multiple Access (W-CDMA).

Referring to FIGS. 5 and 6A, the AMC module 150 may be mounted to the circuit board 118, and the conductive ground layer 151 and the radiator 141 may be electrically connected to the circuit board 118, respectively.

Each of the first and second dielectric substances 154 and 155 is provided with an upper surface, a lower surface and side surfaces. The first conductors 152*a* are arranged on the upper surface of the first dielectric substance 154, and the conductive ground layer 151 is arranged on the lower surface of the first dielectric substance 154.

On the side surfaces of the first dielectric substance 154, formed is a connection path 156 for electrically connecting the first conductors 152*a* arranged at the edge of the first dielectric substance 154 to the conductive ground layer 151. The connection path 156 is extending from the first conductive layer 152 toward two side surfaces of the first dielectric substance 154, thereby being electrically connected to the conductive ground layer 151. The connection path 156 may be formed by soldering, etc.

The supporting member 142 is arranged on the upper surface of the second dielectric substance 155, and the lower surface of the supporting member 142 is configured to cover the first conductive layer 152. The radiator 141 patterned on the supporting member 142 is extending to consecutive side surfaces of the first and second dielectric substances 154 and 155, thereby being electrically connected to the circuit board 118.

An extension portion 141*a* of the radiator 141 is electrically connected to the circuit board 118. This may allow the radiator 141 to form a monopole antenna. However, the present invention is not limited to this. That is, the radiator 141 may form a planar inverted F antenna (PIFA), a dipole antenna, a strip antenna, etc. according to a structure of the connection path 156.

Via holes 118*b* through which the conductive ground layer 151 and a ground layer 118*a* of the circuit board 118 are electrically connected to each other are formed at the circuit board 118. That is, a ground of the AMC module 150 is extended through a path connected to the conductive ground layer 151, via holes 118*b*, and the ground layer 118*a*.

Figure 8A:
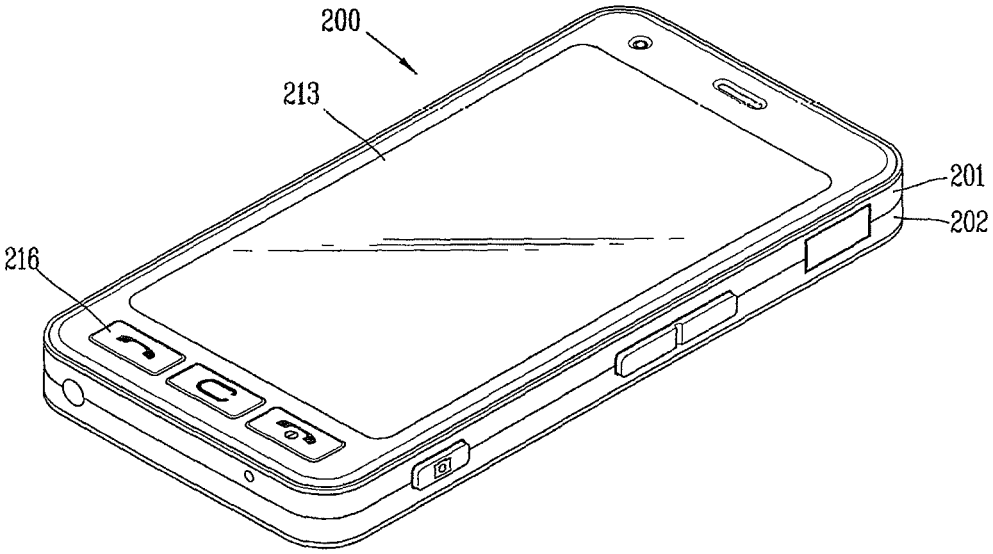
FIGS. 8A and 8B are respectively a perspective view and a rear disassembled perspective view of a portable terminal according to another embodiment of the present invention.
Figure 8B:
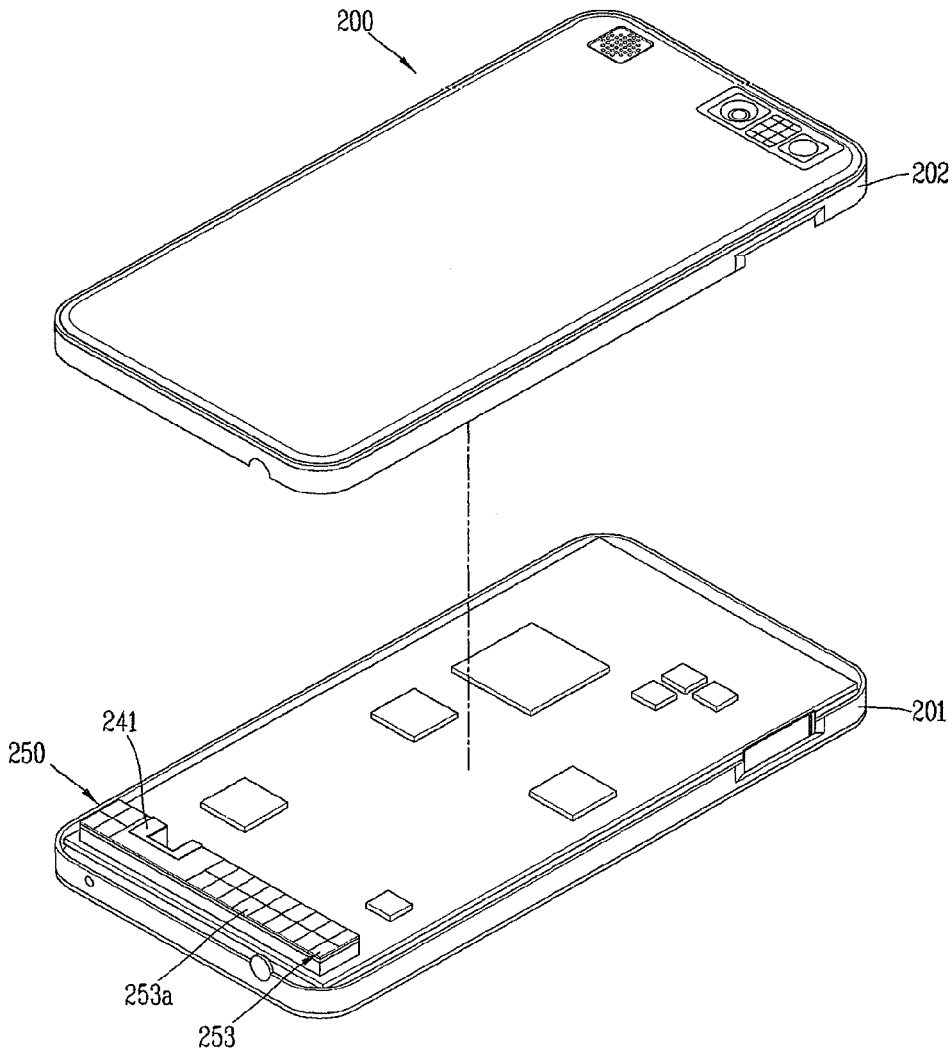

FIGS. 8A and 8B are respectively a perspective view and a rear disassembled perspective view of a portable terminal according to another embodiment of the present invention.

The portable terminal 200 is provided with a bar type terminal body. The terminal body includes a front case 201 and a rear case 202 which form the appearance of the portable terminal 200, and a display unit 213 occupies most of a main surface of the front case 201.

Referring to FIGS. 8A and 8B, a radiator 241 is disposed toward the rear case 202, and the AMC module 250 is arranged at a region adjacent to one end of two ends of the display unit 213. A user input unit 216 may be arranged so as to overlap the AMC module 250.

A second conductive layer 253 is provided with second conductors 253*a* arranged in the form of lattices. Although not shown, a first conductive layer 252 is also provided with first conductors 252*a* arranged in the form of lattices. The first and second conductive layers 252 and 253 are implemented so that arrangement pitches of the first and second conductors 252*a* and 253*a* can not be on the same line. The conductors 252*a* and 253*a* consist of cells having an approximate square shape. This may allow slits generated by the arrangement pitches to be formed as much as possible on the same area. Accordingly, an impedance of the AMC module 250 may be increased.

Figure 9A:
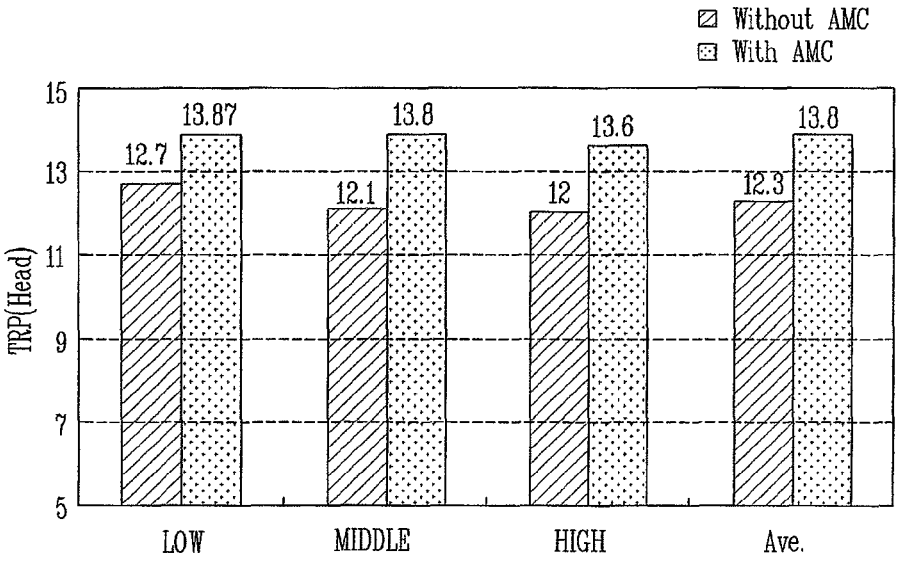
FIGS. 9A and 9B are graphs respectively comparing total radiated power (TRP) when the AMC module is implemented with TRP when the AMC module is not implemented, and comparing a specific absorption ratio (SAR) of electromagnetic waves in a human's body when the AMC module is implemented with a SAR when the AMC module is not implemented.

An advantage of the present invention to increase antenna efficiency by the AMC module will be explained in more detail with reference to FIGS. 9A and 9B. FIG. 9A is a graph comparing total radiated power (TRP) when the AMC module is implemented with TRP when the AMC module is not implemented, and FIG. 9B is a graph comparing a specific absorption ratio (SAR) of electromagnetic waves in a human's body when the AMC module is implemented with a SAR when the AMC module is not implemented.

Figure 9B:
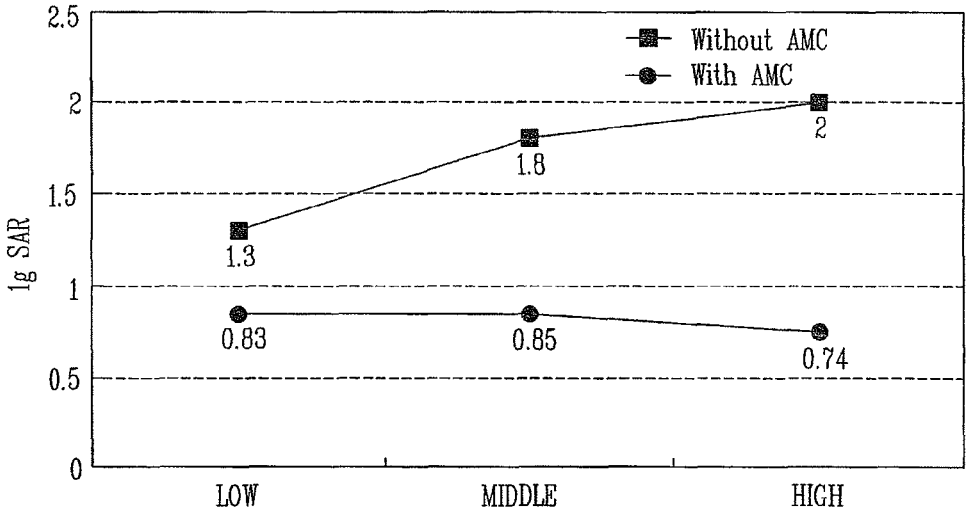

The graphs of FIGS. 9A and 9B show each TRP and each SAR of the portable terminal which is in a wireless communication, which have been measured from a lower part of a user's head to an upper part. Referring to FIG. 9A, when the AMC module of the present invention is implemented, the TRP is improved by approximately 1.5 dB, and the SAR with respect to 1 g of electromagnetic waves is reduced by approximately 1.2 W/kg.

Figure 10A:
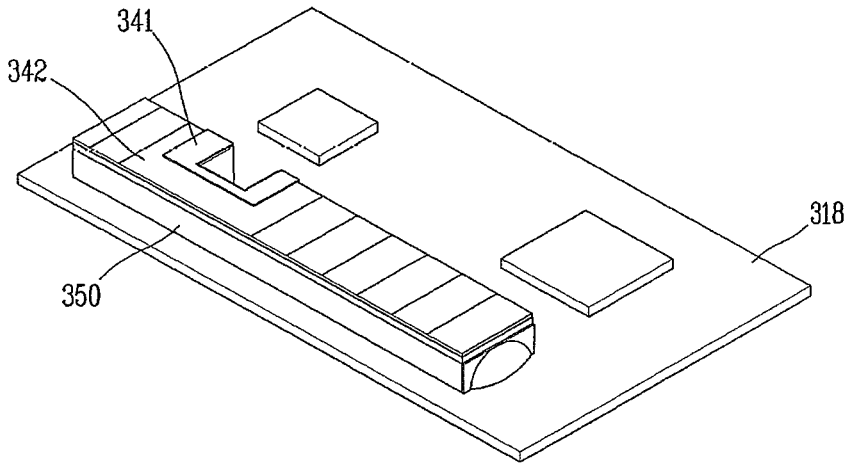
FIGS. 10A to 10C are conceptual views and a graph showing changes of radiation efficiency and a specific absorption ratio (SAR) of electromagnetic waves in a human's body according to a size of the artificial magnetic conductor module of the present invention.
Figure 10B:
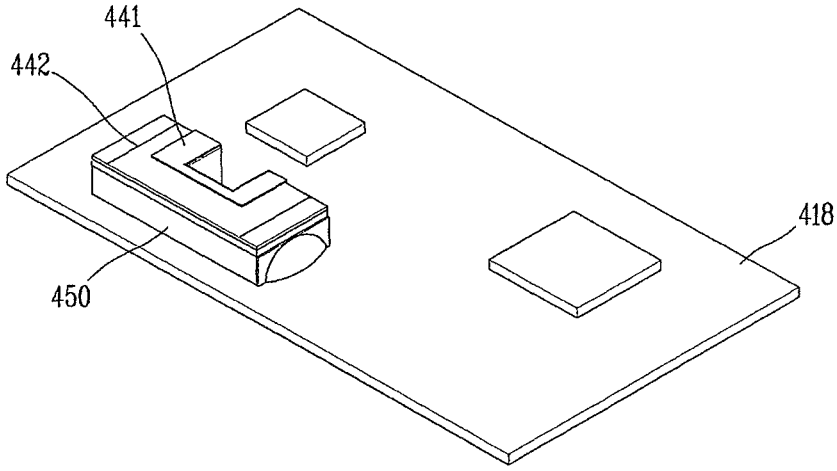
Figure 10C:
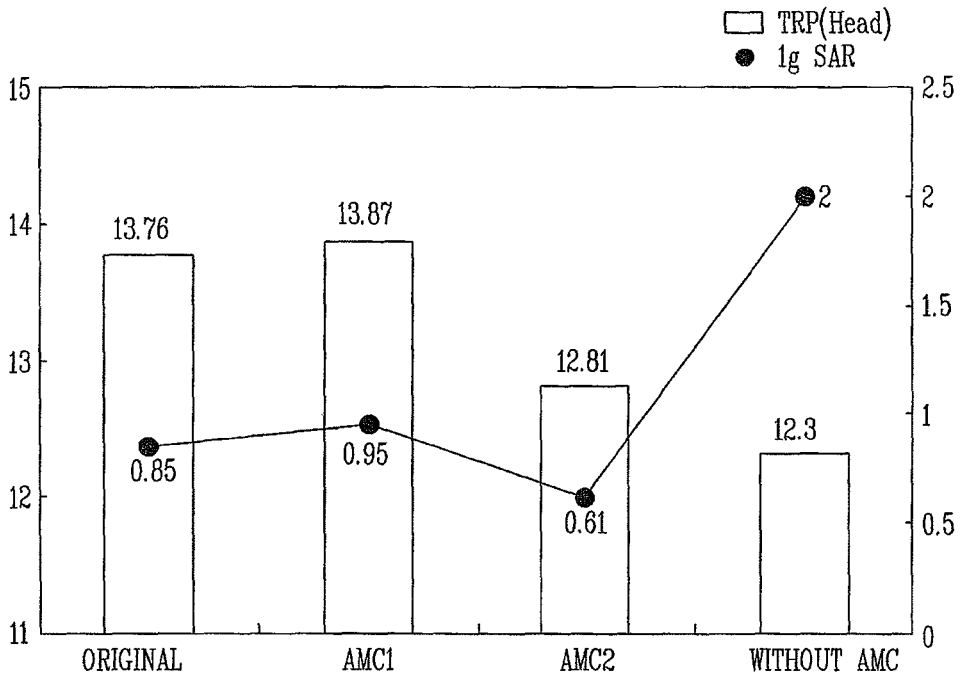

FIGS. 10A to 10C are conceptual views and a graph showing changes of radiation efficiency and a specific absorption ratio (SAR) of electromagnetic waves in a human's body according to a size of the AMC module of the present invention.

FIG. 10A illustrates an AMC module 350 (AMC 1) implemented by removing the first and second conductors 152*a* and 153*a* of the AMC module 150 of FIG. 5 one by one, and FIG. 10B illustrates an AMC module 450 (AMC 2) implemented such that each of the second conductors is partially or entirely covered by the supporting member 442 or the radiator 441.

The AMC module 450 (AMC2) of FIG. 10B may be formed by removing the first and second conductors 152*a* and 153*a* from the AMC module 150 of FIG. 5 as much as possible.

Referring to the graph of FIG. 10C, it can be seen that a specific absorption ratio (SAR) of electromagnetic waves in a human's body is hardly increased even if the first and second conductors 152*a* and 153*a* are removed from the AMC module of FIG. 5 until the AMC module 150 has a similar size to the radiator. Furthermore, a decrease width of total radiated power (TRP) in the AMC module of FIG. 10C is narrower than that in the AMC module 150 of FIG. 5.

Accordingly, as shown in FIG. 10B, a small AMC module may be configured to have improved TRP and a reduced SAR. This may allow a slimmer portable terminal to be implemented.

Figure 11:
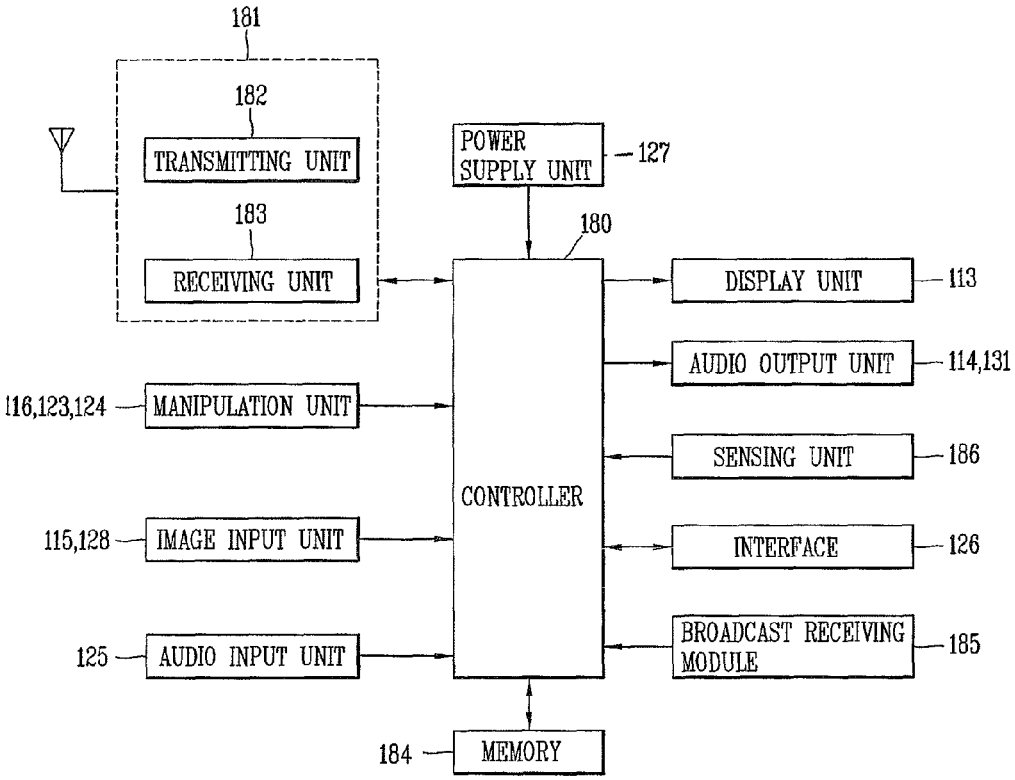
FIG. 11 is a block diagram of a portable terminal according to the present invention.

FIG. 11 is a block diagram of the portable terminal according to the present invention.

Referring to FIG. 11, the portable terminal according to one embodiment of the present invention may comprise components, such as a wireless communication module 181, manipulation units 116, 123 and 124, image input units 115 and 128, an audio input unit 125, a display unit 113, audio output units 114 and 131, a sensing unit 186, an interface 126, a broadcast receiving module 185, a memory 184, a power supply unit 127, and a controller 180.

The controller 180 typically controls the overall operations of the portable terminal. For example, the controller 180 performs the control and processing associated with telephony calls, data communications, video calls, and the like.

Furthermore, the controller 180 not only performs the general functions, but also controls the operation of the portable terminal according to the present invention.

A wireless communications module 181 transmits or receives wireless signals to/from a base station through an antenna. For instance, the wireless communications module 181 transmits or receives voice data, text data, video data, and control data under control of the controller 180. And, the wireless communications module 181 includes a transmitting portion 182 for transmitting a signal through a modulation process, and a receiving portion 183 for demodulating a received signal.

As shown in FIG. 1, the manipulation units 116, 123 and 124 provide, to the controller 180, key input data input by a user so as to control the operation of the portable terminal. The manipulation units 116, 123 and 124 may be implemented as dome switches or a touch pad (e.g., static pressure/capacitance), or a jog wheel or a jog switch.

The image input units 115 and 128 process image frames of still images or moving images captured by an image sensor in a video call mode or a capturing mode. Then, the processed image frames are converted into video data that can be displayed on the display unit 113, and then are output to the display unit 113.

Under control of the controller 180, the image frames processed by the image input units 115 and 128 may be stored in the memory 184, or may be outwardly transmitted through the wireless communications module 181.

The audio input unit 125 receives external audio signals by a microphone in a call mode, or a recording mode, or a voice recognition mode, and so on, and then processes the received audio signals into electric voice data. In the case of a call mode, the processed voice data is converted into data that can be transmitted to the base station through the wireless communications module 181, and then is output to the wireless communications module 181. In the case of a recording mode, the processed voice data is output so as to be stored in the memory 184.

The audio input unit 125 may include assorted noise removing algorithms to remove noise generated in the course of receiving an external audio signal.

The display unit 113 may display information processed in the portable terminal. For instance, when the portable terminal is in a call mode, User Interface (UI) or Graphic User Interface (GUI) relating to a call is displayed under control of the controller 180. When the portable terminal is in a video call mode or a capturing mode, a captured image or UI or GUI is displayed under control of the controller 180. And, when the display unit 113 includes a touch screen, it serves as an input device as well as an output device.

In various modes including a call-receiving mode, a call-placing mode, a recording mode, a voice recognition mode and a broadcast reception mode, the audio output units 114 and 131 convert audio data received from the wireless communication module 181, or audio data stored in the memory 184 thereby to outwardly output under control of the controller 180.

The audio output units 114 and 131 output audio signals relating to functions executed in the portable terminal (e.g., call signal receiving sound, message receiving sound, and so on). The audio output units 114 and 131 include a speaker, a receiver, a buzzer, and so on.

The sensing unit 186 senses the current status of the portable terminal such as an open/close status of the portable terminal, a position of the portable terminal, and presence or absence of a user's contact with the portable terminal, thereby generating sensing signals to control the operation of the portable terminal. As an example, when the portable terminal is a slide-type portable terminal, the sensing unit 166 may sense whether a sliding portion of the portable terminal is open or closed. Then, the sensing unit 186 outputs results of the sensing to the controller 180, and thereby the operation of the portable terminal is controlled. Other examples include the sensing unit 186 sensing the presence or absence of power provided by the power supply unit 127, the presence or absence of coupling or other connection between the interface 126 and an external device, and so on.

The interface 126 interfaces a wire/wireless headset, an external charger, a wire/wireless data port, and a card socket (e.g., memory card, SIM/UIM card) rather than the portable terminal, with all types of external devices connected to the portable terminal. The interface 126 receives data or power from an external device, and transmits it to each component inside the portable terminal. Otherwise, the interface 126 transmits data inside the portable terminal to an external device.

The memory 184 may store a program to activate the controller 180, or may temporarily store input/output data (e.g., phonebook, messages, still images, moving images, and so on).

Furthermore, the memory 184 stores a program for controlling the operation of the portable terminal of the present invention.

The memory 184 includes the concepts of the general hard disc, card-type memory (e.g., SD or XD memory), flash memory, RAM, ROM, and so on.

The broadcast receiving module 185 receives a broadcasting signal transmitted through satellite or terrestrial waves, etc., and converts the signal into broadcasting data that can be output to the audio output units 114 and 131, and the display unit 113 thereby to output it to the controller 180. The broadcast receiving module 185 receives broadcasting-related additional data (e.g., Electric Program Guide: EPG channel list, etc.). Broadcasting data and additional data converted by the broadcast receiving module 185 may be stored in the memory 184.

The power supply unit 127 receives external or internal power under control of the controller 180, and supplies the power to each component of the portable terminal.

The portable terminal of the present invention may have the following advantages.

Firstly, since the AMC module is arranged so as to be adjacent to the radiator, electromagnetic waves transmitted or received from/to the portable terminal may be radiated in one direction. This may implement an antenna device having improved TRP and a reduced SAR.

Secondly, a structure of a slimmer antenna may be implemented by laminating the AMC module and the radiator on each other, and design degrees of freedom with respect to an inner space of the portable terminal may be enhanced.

Thirdly, an external size of the AMC module may be reduced and an impedance of the AMC module may be increased by the first and second conductive layers.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A portable terminal, comprising:

a terminal body;

at least one display disposed on a first surface of the terminal body, and configured to display visual information;

a radiator including a conductive material, and configured in a preset pattern to transmit or receive wireless signals;

a circuit board mounted to the terminal body, and configured to process the wireless signal by being electrically connected to the radiator; and an artificial magnetic conductor module disposed to overlap the radiator, and configured to reflect the wireless signal, wherein the artificial magnetic conductor module includes:

a conductive ground layer;

a first conductive layer electrically connected to the conductive ground layer, and including a plurality of first conductors arranged at positions of a predetermined distance from the conductive ground layer; and a second conductive layer configured to cover the first conductive layer, and including a plurality of second conductors that are parallel to the first conductors, wherein the radiator is disposed to face a second surface of the terminal body, and the second surface of the terminal body is opposite to the first surface, and wherein the artificial magnetic conductor module is disposed between the radiator and the first surface so as to reflect wireless signals which are toward the front surface among wireless signals radiated from the radiator.

2. The portable terminal of claim 1, further comprising:

slits between any two adjacent first conductors from the plurality of first conductors, wherein the second conductors are arranged to cover the slits.

3. The portable terminal of claim 2, wherein each of the second conductors is configured to be arranged at a same distance from each other as each of the plurality of the first conductors is from each other.

4. The portable terminal of claim 1, wherein each of the first and second conductors includes a length and a width, and wherein the length is a longer side of the each of the first and second conductors, and the width of the each of the first and second conductors is configured to be placed consecutively next to each other to construct a longer side of the first and the second conductive layers.

5. The portable terminal of claim 1, wherein each of the first and second conductive layers is arranged to dispose the first and second conductors on one line in one direction.

6. The portable terminal of claim 1, wherein the radiator is parallel to the second conductors that are positioned adjacent to each other.

7. The portable terminal of claim 1, wherein a spacing distance between the first conductive layer and the second conductive layer is shorter than the predetermined distance between the conductive ground layer and the first conductive layer.

8. The portable terminal of claim 1, wherein the artificial magnetic conductor module further includes:

a first dielectric substance filled between the conductive ground layer and the first conductive layer; and a second dielectric substance filled between the first conductive layer and the second conductive layer.

9. The portable terminal of claim 8, wherein the first dielectric substance includes an upper surface, a lower surface, and side surfaces, and wherein the first conductors are on the upper surface of the first dielectric substance, the conductive ground layer is on the lower surface of the first dielectric substance, and a connection path for electrically connecting the first conductors arranged at an edge of the first dielectric substance to the conductive ground layer is on the side surfaces of the first dielectric substance.

10. The portable terminal of claim 1, further comprising:

a supporting member having a first surface arranged at the second conductive layer, and a second surface provided with the radiator.

11. The portable terminal of claim 10, wherein the supporting member is implemented as a thin film formed of a non-conductive material.

12. The portable terminal of claim 10, wherein the supporting member or the radiator is configured to cover one or more parts of each of the second conductors.

13. The portable terminal of claim 1, further comprising:

a user input unit disposed on the first surface of the terminal body, and configured to receive a control command, wherein the artificial magnetic conductor module is disposed to face the at least one display or the user input unit.

14. The portable terminal of claim 1, wherein the artificial magnetic conductor module is mounted to the circuit board, and each of the conductive ground layer and the radiator is electrically connected to the circuit board.

15. The portable terminal of claim 14, wherein holes are provided at the circuit board to electrically connect the conductive ground layer and a ground layer of the circuit board.

* * * * *